US005915922A

United States Patent [19]

Wiethe et al.

[11] Patent Number: 5,915,922

[45] Date of Patent: Jun. 29, 1999

[54] SOUND DAMPENING HOUSING FOR A BLOWER IN A HOUSEHOLD APPLIANCE, IN PARTICULAR A HOUSEHOLD CLOTHES DRYER

[75] Inventors: Reinhard Wiethe; Dietrich Pohl, both of Berlin, Germany

[73] Assignee: BSH Bosch und Siemens Hausgeraete GmbH, Munich, Germany

[21] Appl. No.: 08/527,754

[22] Filed: Sep. 13, 1995

[30] Foreign Application Priority Data

Sep. 13, 1994 [DE] Germany ..... 4432567

[51] Int. Cl.[6] ..... F04D 29/42

[52] U.S. Cl. ..... 415/204; 415/119; 415/206; 415/214.1

[58] Field of Search ..... 415/119, 204, 415/214.1, 173.1, 196, 197, 206

[56] References Cited

U.S. PATENT DOCUMENTS

| | | | |
|---|---|---|---|
| 1,952,179 | 3/1934 | Milkowski et al. | 415/196 |
| 2,225,398 | 12/1940 | Hamblin | 415/119 X |
| 2,557,201 | 6/1951 | Punt | 415/119 X |
| 3,174,682 | 3/1965 | Wilfert et al. | 415/119 X |
| 3,312,389 | 4/1967 | Matsui | 415/119 X |
| 4,174,020 | 11/1979 | Challis | 415/119 X |

FOREIGN PATENT DOCUMENTS

| | | | |
|---|---|---|---|
| 926 088 | 5/1963 | United Kingdom | 415/119 |

*Primary Examiner*—Christopher Verdier
*Attorney, Agent, or Firm*—Herbert L. Lerner; Laurence A. Greenberg

[57] ABSTRACT

A housing assembly for a blower in a household appliance such as a household clothes dryer, which may be a component of a household washing machine, includes a spiral housing having a spiral contour. A radial blower wheel is rotatably built into the spiral housing for receiving an axial air supply. A housing wall separably surrounds the spiral housing and has a jacket with a wall form being adapted to the spiral contour of the spiral housing and extending spaced apart from the spiral contour of the spiral housing. A device may be provided for maintaining a spacing between the spiral contour of the spiral housing and the jacket of the housing wall.

20 Claims, 4 Drawing Sheets

SOUND DAMPENING HOUSING FOR A BLOWER IN A HOUSEHOLD APPLIANCE, IN PARTICULAR A HOUSEHOLD CLOTHES DRYER

BACKGROUND OF THE INVENTION

Field of the Invention

The invention relates to a housing for a blower in a household appliance, in particular a household clothes dryer, which may also be a component of a household washing machine, having a radial blower wheel that is rotatably built into a spiral housing and to which air is supplied axially.

One such housing is known from German Patent DE 31 35 292 C2. The blower housing therein is a component of a plastic supporting body for a clothes dryer.

Since that kind of plastic supporting body in principle is conceivable for all large household appliances that include a blower housing, the following remarks pertain to such household appliances as well.

Blower housings which are integrated into the known plastic supporting body are subject, in terms of their construction, above all to demands for good manufacturability of a large injection molded or cast piece. Suitable configurations of reinforcements and molded inclines each play a major role. The consequence is that compromises must be made in constructing a blower housing in terms of the optimal shaping of the housing spiral, so it is not even approximately possible to attain the optimum construction of a blower housing with respect to blower power and noise projection. Moreover, such restrictions are also responsible for the fact that that kind of integrated plastic blower housing must also be composed of a relatively large number of individual parts.

SUMMARY OF THE INVENTION

It is accordingly an object of the invention to provide a housing for a blower in a household appliance, in particular a household clothes dryer, which overcomes the above-mentioned disadvantages of the previously known devices of this general type and which is integrated into a plastic supporting body in such a way that an optimal adaptation of the entire blower, in terms of its power and its sound projection, can be adapted to demands made on the household appliance to be built.

With the foregoing and other objects in view there is provided, in accordance with the invention, a housing assembly for a blower in a household appliance such as a household clothes dryer, which may be a component of a household washing machine, comprising a spiral housing having a spiral contour; a radial blower wheel being rotatably built into the spiral housing for receiving an axial air supply; a housing wall separably surrounding the spiral housing and having a jacket with a wall form being adapted to the spiral contour of the spiral housing and extending spaced apart from the spiral contour of the spiral housing.

In accordance with another feature of the invention, there is provided a device for maintaining a spacing between the spiral contour of the spiral housing and the jacket of the housing wall.

In this kind of structural embodiment, the surrounding housing wall can be part of the plastic supporting body, and the spiral housing can be optimally adapted in its inner shaping to the required power and the predetermined noise projection requirement. Without modifying the plastic supporting body it is therefore possible to install or provide for various levels of blower power and noise projection intensities.

In accordance with a further feature of the invention, in addition to the bottom of the spiral housing, the surrounding housing wall also has a bottom, which is pierced by the shaft of the blower wheel. This is advantageous from a structural standpoint. As a result, the spiral housing can be fixed not only at the jacket but also at the bottom.

In accordance with an added feature of the invention, the surrounding housing wall is split along a plane that coincides with the axis of the blower wheel. This is especially advantageous in view of the plastic-specific production options and assembly options.

In accordance with an additional feature of the invention, on the air supply side, the housing wall has an air inlet disposed coaxially with the blower wheel and partly covering the blower wheel. This is also especially highly advantageous. This air inlet presents possibilities for adapting various shapes to the air supply, which also allows various noise abatement provisions to be made.

In accordance with yet another feature of the invention, there is provided a funnel-like insert releaseably fitted into the air inlet. In accordance with yet a further feature of the invention, there is provided a tubular acoustical insulation component releaseably inserted into the air inlet. In accordance with yet an added feature of the invention, these two provisions can also be combined, if the funnel-like insert is connected to the tubular acoustical insulation component, in particular by a plug-type connection.

In accordance with yet an additional feature of the invention, which is especially advantageous in terms of noise abatement provisions, the jacket of the spiral housing is perforated. As a result, in cooperation with the interior of the spiral housing, various sizes and shapes of resonant chambers can be formed, which provide for flattening of the amplitudes of individual sound projection resonant points. This reduces the total sound being projected.

In accordance with again another feature of the invention, with a view to lowering the amount of sound being produced, the outside of the jacket of the spiral housing and/or the inside of the jacket of the surrounding housing wall are lined with a vibration-damping material.

In accordance with a concomitant feature of the invention, instead or in addition, the surfaces of the outside of the jacket of the spiral housing and/or of the inside of the jacket of the surrounding housing wall may be rough to creviced. The scattering of sound attainable thereby when sound waves strike the walls also contributes to reducing the sound projection power.

Other features which are considered as characteristic for the invention are set forth in the appended claims.

Although the invention is illustrated and described herein as embodied in a housing for a blower in a household appliance, in particular a household clothes dryer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
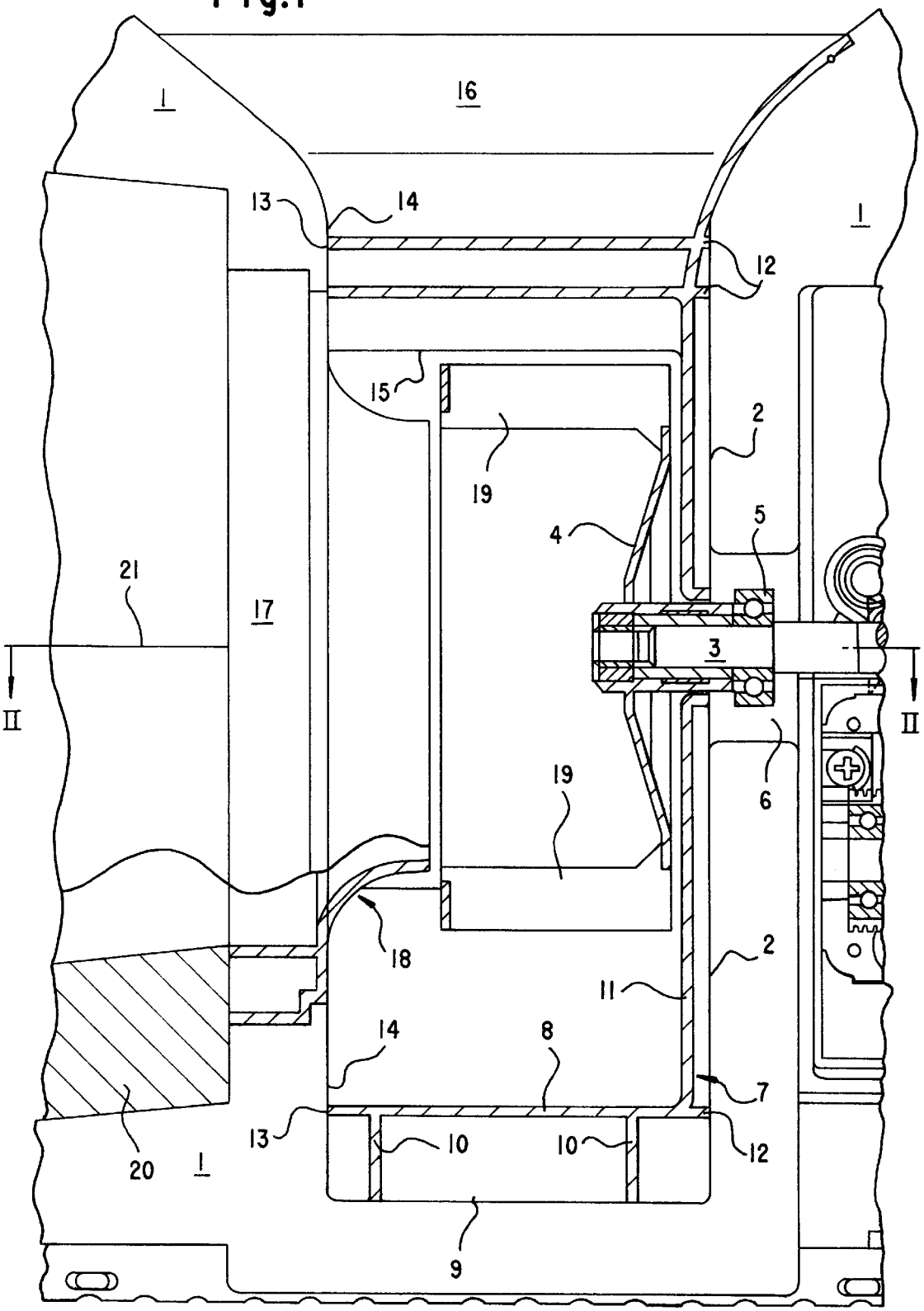
FIG. 1 is a fragmentary, diagrammatic, sectional view taken along a parting plane 22 of FIG. 2, through a complete blower which is equipped, in accordance with the invention, for cooling air of a condensation-type clothes dryer.

Referring now to the figures of the drawings in detail and first, particularly, to FIG. 1 thereof, there is seen a surrounding housing wall 1 which is integrated into a non-illustrated plastic supporting body, of the kind that is provided in a similar form in German Patent DE 31 35 292 C2, for example. The surrounding housing wall 1 has a bottom 2, which is pierced by a shaft 3 of a blower wheel 4. The shaft 3 (which at the same time is a power takeoff shaft of a motor) is supported in a ball bearing 5, which is secured in a non-illustrated manner in an opening 6 passing through the bottom 2. A spiral housing 7 is inserted into the surrounding housing wall 1 and has a spiral jacket 8 which is kept spaced apart from a jacket 9 of the housing wall 1. This spacing is maintained by annular ribs 10, which are formed onto the outside of the spiral housing 7. The spiral housing 7 is retained in the axial direction inside the surrounding housing wall 1 on a bottom 11 of the spiral housing 7 and on the bottom 2 of the surrounding housing wall 1. This retention of the spiral housing 7 is provided on the one hand by spiral ribs 12 and on the other hand by end surfaces 13 of the spiral jacket 8 on surfaces 14 of the surrounding housing wall 1 that face the bottom 2. Elements 10, 12 and 13 may be considered means for maintaining a spacing between the spiral contour of the spiral housing 7 and the jacket 9 of the housing wall 1. However, such means are not limited to the elements shown. The spiral wall 8 ends in an upper portion of the drawing at an edge 15 facing into the blown air and terminates at an outer spiral end in a blowout funnel 16.

An air inlet 17 is provided coaxially with the blower wheel 4 on the side of the surrounding housing wall 1 facing the bottom 2. Air that is aspirated by the blower wheel 4 is aimed through a funnel-like insert 18 at the center between fan blades 19 of the blower wheel 4. A tubular acoustical insulation component 20 is inserted into the air inlet 17 upstream of the funnel-like insert 18, as seen in the flow direction. On one hand, the funnel-like insert 18 acts to channel the airflow and on the other hand, it acts to quiet noises produced from the airflow.

The acoustical insulation component 20 is constructed in such a way that it can be split into two shells at a parting plane 21. In order to ensure adaptation to modified demands made of the household appliance in terms of power or noise abatement, the spiral housing 7, the fan wheel 4 and the funnel-like insert 18 or the tubular acoustical insulation component 20 can be varied without changing the fundamental component unit (of the plastic supporting body) for the surrounding housing wall 1. Care must merely be taken to ensure that the outer dimensions of the aforementioned components being used remain unchanged, so that they can be fitted into the unchanged surrounding housing wall 1.

Figure 2:
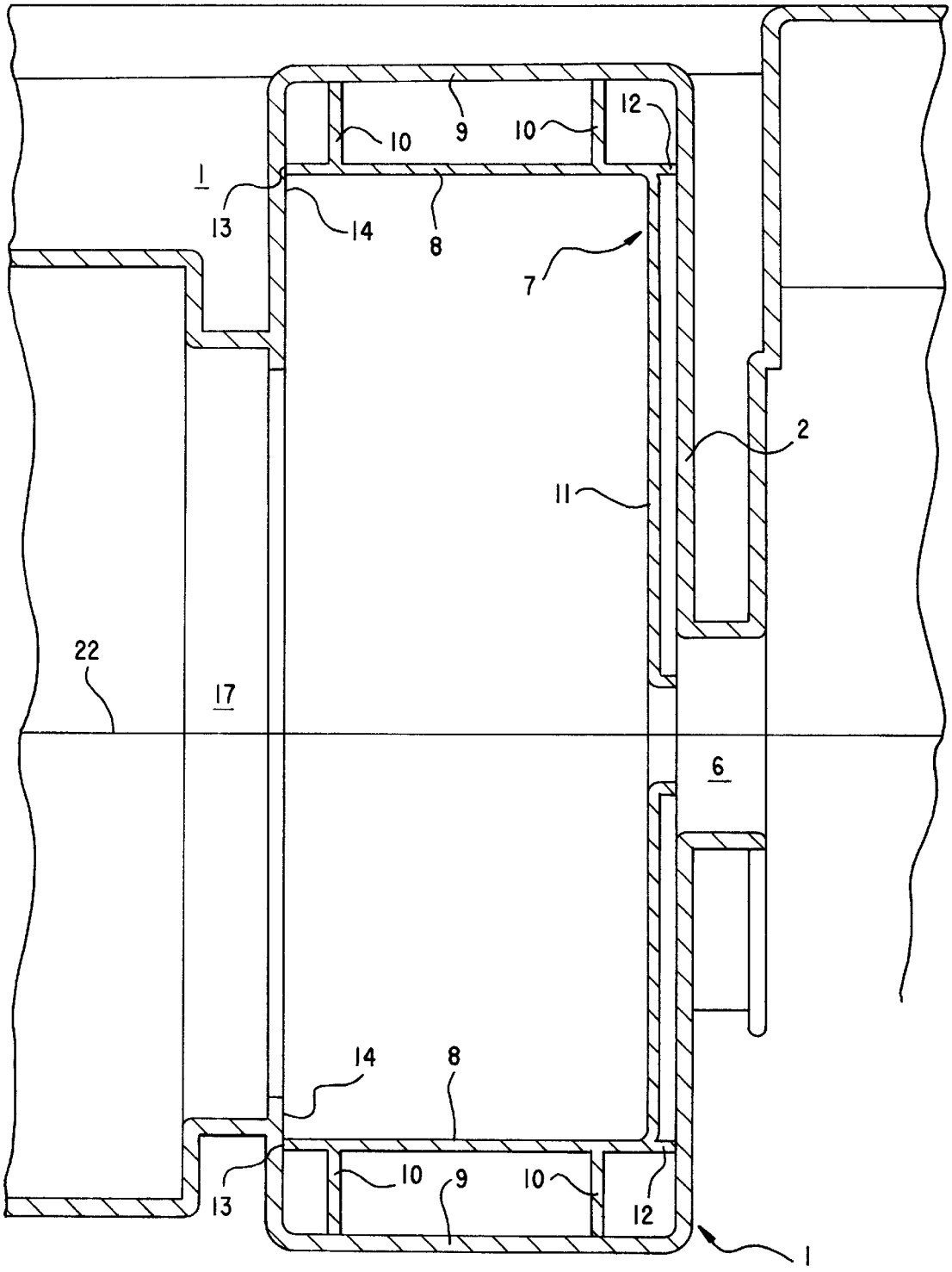
FIG. 2 is a fragmentary, vertical-sectional view taken along a line II—II of FIG. 1, in the direction of the arrows, through a blower housing which is constructed according to the invention.

The view of the surrounding housing wall 1 and the spiral housing 7 which is shown in FIG. 2 without the additional built-in fixtures (motor, blower wheel, funnel-like insert and tubular acoustical insulation component), makes it possible to see a parting plane 22 which coincides with the axis of the blower wheel 4 and shows that the spiral housing 7 can readily be removed from the hollow spaces of the surrounding housing wall 1 once the two shells of the surrounding housing wall 1 have been separated. In fact, as a result, it is readily possible to remove the spiral housing 7 from the void in the surrounding housing wall 1, after raising the upper part of the housing wall and unscrewing the fan wheel 4.

Figure 3:
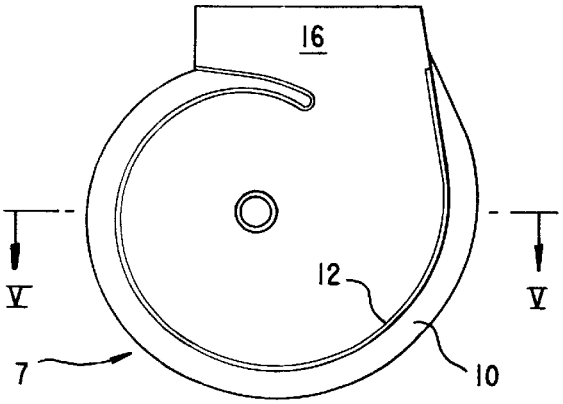
FIGS. 3–8 are reduced, elevational views of a spiral housing that can be inserted into the surrounding housing wall, with FIG. 5 being taken along a line V—V of FIG. 3, in the direction of the arrows, and FIG. 8 being taken along a line VIII—VIII of FIG. 7, in the direction of the arrows.
Figure 4:
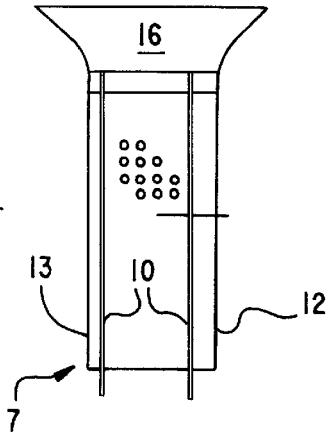
Figure 5:
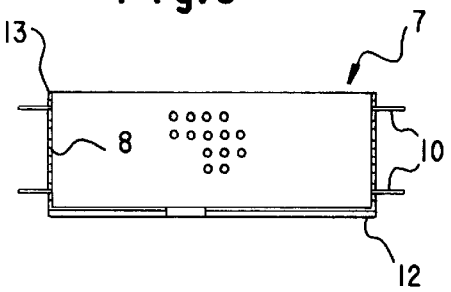
Figure 6:
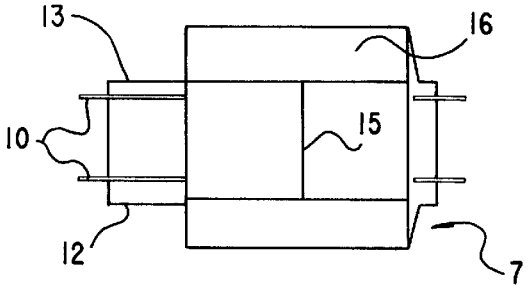
Figure 7:
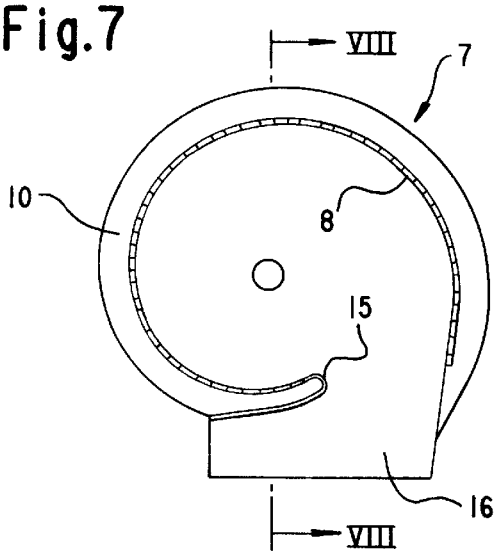
Figure 8:
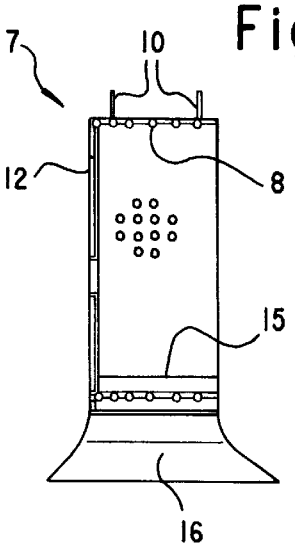

The reduction in size of the spiral housing 7 which is chosen in FIGS. 3–8 shows its contours from all six directions. FIGS. 3 and 7 are lateral views of the spiral housing 7, which are taken in the case of FIG. 3 from the direction of the motor and in the case of FIG. 7 from the air supply side. FIG. 4 shows the spiral housing of FIG. 3 from the left, and FIG. 5 shows a section indicated by the line V—V of FIG. 3. FIG. 6 is a view of the spiral housing 7 of FIG. 3 as seen from above, and FIG. 8 is a view of a section taken along the line VIII—VIII of FIG. 7.

Figure 9:
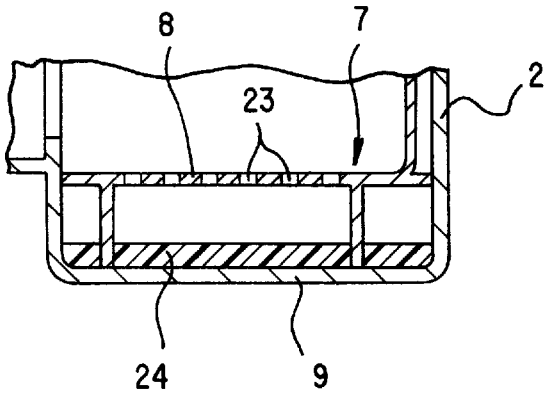
FIGS. 9–10 are fragmentary sectional views showing vibration dampening material on a spiral housing and a housing wall.
Figure 10:
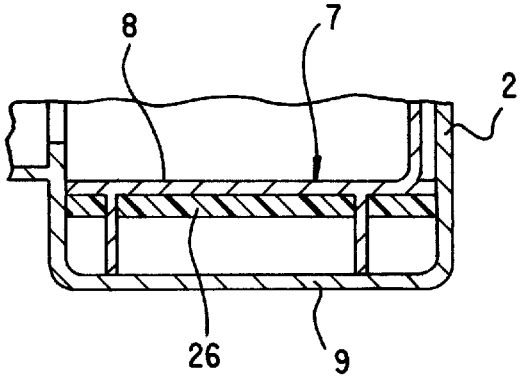
Figure 11:
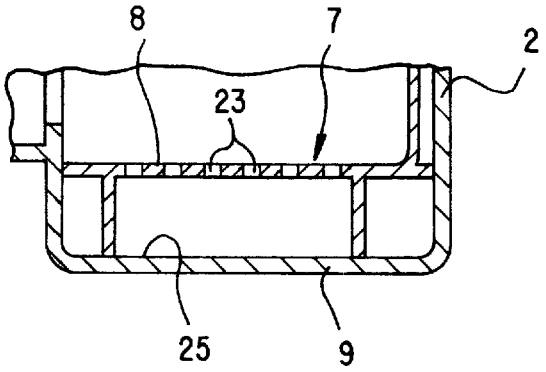
FIGS. 11–12 are fragmentary sectional views showing the spiral housing and the housing wall having a roughened or creviced surface.
Figure 12:
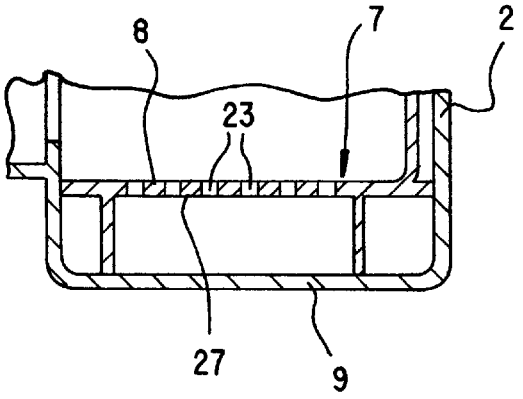

It may be seen from its very construction alone (with double walls, and therefore few acoustical bridges), that the special spiral housing 7 placed separately into the shell of the surrounding housing wall 1 entails a reduced risk of noise development. However, additional provisions for noise abatement can also be employed in addition. For instance, the spiral jacket 8 may be perforated with a more or less great density and width, so that noise arising inside the spiral housing will pass through holes 23 as shown in FIG. 9, into the space between the walls 8 and 9 and be dissipated there. To that end, it may be advantageous to make these interstices finer and for them to have different volumes. Further provisions could be to line the surfaces of the walls 8 and 9 inside the interstices with insulating materials 24,26 as shown in FIGS. 9 and 10, and/or to provide for the scattering of acoustical reflections through the use of a rough or creviced surface 25,27 as shown in FIGS. 11 and 12.

The concept of the blower housing according to the invention allows the construction of an optimal cooling blower spiral, while taking into account sound minimization and possibilities for adapting the power of the blower housing and the blower wheel to be built into a plastic supporting body. Due to requirements of the production technology for plastic injection molded or cast bodies, known permanently molded-in spirals in such plastic supporting bodies usually depart sharply in shape and power from the ideal spiral housings, and typically are larger than necessary and are the source of pronounced operating noise. The concept according to the invention allows an optimally shaped, small spiral housing that is adapted ideally to the particular operating process to be built in. This concept also allows the optimal adaptation of a suction nozzle (funnel-like insert 18, tubular acoustical insulation component 20). In summary, the advantages of the concept of the invention as compared with the prior art can be listed as follows:

ideal shape of the spiral housing;

high air power at small blower wheel diameter;

possible perforation of the inner spiral and/or the creation of acoustical dead spaces;

double-walled structure and minimal acoustical bridges, and available installation space for insulating materials;

as a result, extremely highly suitable preconditions for provisions for reducing incipient noise and abating existing noise;

options for adaptation for a given optimum in the spiral housing and in section nozzles, depending on the demands on the operating process; and no outlays for modification of a large tool for manufacturing the plastic supporting body.

We claim:

1. A housing assembly for a blower in a household appliance, comprising:

a spiral housing having a spiral contour;

a radial blower wheel rotatably mounted in said spiral housing for receiving an axial air supply; and a housing wall separably surrounding said spiral housing for allowing an insertion and removal of said spiral housing to and from said surrounding housing wall, said housing wall having a jacket with a wall form adapted to said spiral contour of said spiral housing and extending spaced apart from said spiral contour of said spiral housing;

wherein said blower wheel has an axis, and said surrounding housing wall is split along a plane coinciding with said axis of said blower wheel.

2. The housing assembly according to claim 1, including means for maintaining said spacing between said spiral contour of said spiral housing and said jacket of said housing wall.

3. The housing assembly according to claim 1, wherein said spiral housing has a bottom, said surrounding housing wall has a bottom, and said blower wheel has a shaft piercing said bottoms of said spiral housing and said surrounding housing wall.

4. The housing assembly according to claim 1, wherein said housing wall has an air inlet on an air supply side, and said air inlet is coaxial with and partly congruent with said blower wheel, and including a funnel-like insert mounted in said air inlet.

5. The housing assembly according to claim 4, including a tubular acoustical insulation component being releaseably inserted into said air inlet.

6. The housing assembly according to claim 5, wherein said funnel-like insert is connected to said tubular acoustical insulation component.

7. The housing assembly according to claim 6, wherein said funnel-like insert and said tubular acoustical insulation component have a plug-type connection.

8. The housing assembly according to claim 1, wherein said spiral housing has a perforated jacket.

9. The housing assembly according to claim 8, wherein said jacket of said spiral housing has an outer surface, said jacket of said surrounding housing wall has an inner surface, and at least one of said surfaces has a creviced texture for assisting in dampening noise.

10. The housing assembly according to claim 8, wherein said jacket of said spiral housing has an outer surface, said jacket of said surrounding housing wall has an inner surface, and at least one of said surfaces has a texture between rough and creviced for assisting in dampening noise.

11. The housing assembly according to claim 1, wherein said spiral housing has a jacket being lined on the outside with a vibration-damping material.

12. The housing assembly according to claim 11, wherein said jacket of said spiral housing has an outer surface, said jacket of said surrounding housing wall has an inner surface, and at least one of said surfaces has a creviced texture for assisting in dampening noise.

13. The housing assembly according to claim 11, wherein said jacket of said spiral housing has an outer surface, said jacket of said surrounding housing wall has an inner surface, and at least one of said surfaces has a texture between rough and creviced for assisting in dampening noise.

14. The housing assembly according to claim 1, wherein said jacket of said surrounding housing wall is lined on the inside with a vibration-damping material.

15. The housing assembly according to claim 14, wherein said spiral housing has a jacket with an outer surface, said jacket of said surrounding housing wall has an inner surface, and at least one of said surfaces has a creviced texture for assisting in dampening noise.

16. The housing assembly according to claim 14, wherein said spiral housing has a jacket with an outer surface, said jacket of said surrounding housing wall has an inner surface, and at least one of said surfaces has a texture between rough and creviced for assisting in dampening noise.

17. A housing assembly for a blower in a household clothes dryer, comprising:

a spiral housing having a spiral contour;

a radial blower wheel rotatably mounted in said spiral housing for receiving an axial air supply; and a housing wall separably surrounding said spiral housing for allowing an insertion and removal of said spiral housing to and from said surrounding housing wall, said housing wall having a jacket with a wall form adapted to said spiral contour of said spiral housing and extending spaced apart from said spiral contour of said spiral housing;

wherein said blower wheel has an axis, and said surrounding housing wall is split along a plane coinciding with said axis of said blower wheel.

18. The housing assembly according to claim 17, including means for maintaining said spacing between said spiral contour of said spiral housing and said jacket of said housing wall.

19. A housing assembly for a blower in a household washing machine, comprising:

a spiral housing having a spiral contour;

a radial blower wheel rotatably mounted in said spiral housing for receiving an axial air supply; and a housing wall separably surrounding said spiral housing for allowing an insertion and removal of said spiral housing to and from said surrounding housing wall, said housing wall having a jacket with a wall form adapted to said spiral contour of said spiral housing and extending spaced apart from said spiral contour of said spiral housing;

wherein said blower wheel has an axis, and said surrounding housing wall is split along a plane coinciding with said axis of said blower wheel.

20. The housing assembly according to claim 19, including means for maintaining said spacing between said spiral contour of said spiral housing and said jacket of said housing wall.

* * * * *